US005750151A

United States Patent [19]

Brignola et al.

[11] Patent Number: 5,750,151

[45] Date of Patent: May 12, 1998

[54] SPUN-BONDED WEB

[75] Inventors: Edward L. Brignola, Old Hickory; Alvin A. Fleck, Madison; Price W. LaCroix, Hendersonville; Edward K. Willis, Mt. Juliet; Leon H. Zimmerman, deceased, late of Nashville, all of Tenn., by Patricia B. Zimmerman, legal representative

[73] Assignee: Reemay Inc., Old Hickory, Tenn.

[21] Appl. No.: 853,873

[22] Filed: May 9, 1997

(Under 37 CFR 1.47)

Related U.S. Application Data

[62] Division of Ser. No. 622,312, Mar. 27, 1996, Pat. No. 5,665,300.

[51] Int. Cl.[6] ..... B29C 55/00

[52] U.S. Cl. ..... 425/66; 425/72.2; 264/210.1; 264/210.8

[58] Field of Search ..... 264/210.8, 210.1; 425/72.2, 66, 7

[56] References Cited

U.S. PATENT DOCUMENTS

| | | |
|---|---|---|
| 1,975,132 | 10/1934 | Van Derhoef . |
| 2,536,094 | 1/1951 | McDermott et al. . |
| 2,976,580 | 3/1961 | Riedel . |
| 3,930,292 | 1/1976 | Schippers et al. . |
| 3,991,244 | 11/1976 | Debbas . |
| 3,999,909 | 12/1976 | Schippers et al. . |
| 4,070,218 | 1/1978 | Weber . |
| 4,284,395 | 8/1981 | Kane . |
| 5,009,830 | 4/1991 | Chern . |
| 5,014,396 | 5/1991 | Nieminen . |
| 5,298,097 | 3/1994 | Zamferrari . |
| 5,431,986 | 7/1995 | Ortega et al. . |
| 5,439,364 | 8/1995 | Gerking et al. . |

FOREIGN PATENT DOCUMENTS

| | | | |
|---|---|---|---|
| 50-43277 | 4/1975 | Japan | 264/210.8 |

*Primary Examiner*—Jay H. Woo
*Assistant Examiner*—Robert Hopkins
*Attorney, Agent, or Firm*—Burns, Doane, Swecker & Mathis, L.L.P.

[57] ABSTRACT

An improved apparatus is provided for the formation of a spunbonded fibrous web suitable for service in nonwoven end uses. A melt-processable thermoplastic polymeric material is melt-extruded to form a multifilamentary spinline, is quenched, and is wrapped about at least two spaced driven draw rolls that are surrounded by a shroud prior to collection to form a web, and is bonded to form a spun-bonded nonwoven product. The draw rolls exert a pulling force on the multifilamentary spinline so as to accomplish drawing of the molten multifilamentary spinline prior to complete solidification. The shroud makes possible the self-stringing of the spinline around the draw rolls. A pneumatic jet located at the exit end of the shroud assists in the contact of the multifilamentary spinline with the draw rolls in order to facilitate the imposition of a uniform pulling force and expels the multifilamentary spinline in the direction of its length toward a support where it is collected. The formation of a highly uniform spun-bonded nonwoven is made possible on an expeditious basis.

7 Claims, 1 Drawing Sheet

SPUN-BONDED WEB

This application is a divisional of application Ser. No. 08/622,312, filed Mar. 27, 1996 (now U.S. Pat. No. 5,665,300).

BACKGROUND OF THE INVENTION

Spun-bonded nonwoven webs are important articles of commerce for use in consumer and industrial end uses. Such products commonly possess a textile-like hand and appearance and are useful as a component of disposable diapers, in automotive applications, and in the formation of medical garments, home furnishings, filtration media, carpet backings, fabric softener substrates, roofing felts, geotextiles, etc.

In accordance with the technology of the prior art, a molten melt-processable thermoplastic polymeric material is passed through a spinneret to form a multifilamentary fibrous spinline, is drawn in order to increase tenacity, is passed through a quench zone wherein solidification occurs, is collected on a support to form a web, and is bonded to form a spun-bonded web. The drawing or attenuation of the melt-extruded spinline has been accomplished in the past by passage through a pneumatic forwarding jet or by wrapping about driven draw rolls. An apparatus arrangement utilizing both draw rolls and gas flow is disclosed in U.S. Pat. No. 5,439,364. The equipment utilized for spun-bonded nonwoven production in the past commonly has necessitated relatively high capital expenditures, multiple spinning positions, large volumes of air, and/or has presented denier variability shortcomings when one is interested in the expeditious formation of a nonwoven product on an economical basis.

It is an object of the present invention to provide an improved process for the formation of a spun-bonded web.

It is an object of the present invention to provide a process for the formation of a spun-bonded web that can be carried out on an expeditious basis to form a substantially uniform product having a satisfactory balance of properties.

It is an object of the present invention to provide a process for the formation of a spun-bonded web that is relatively user friendly and offers the ability to routinely produce a quality nonwoven product in the substantial absence of deleterious roll wraps.

It is an object of the present invention to provide an improved process for the formation of a spun-bonded web wherein the spinline is capable of undergoing self-stringing and requires minimal operator intervention.

It is an object of the present invention to provide improved technology that is flexible with respect to the chemical composition of the melt-processable thermoplastic polymeric material that serves as the starting material.

It is an object of the present invention to provide a process that is capable of producing with good denier control a substantially uniform light weight spun-bonded product at relatively high spinning speeds on a reliable basis.

It is another object of the present invention to provide an improved process for the formation of a spun-bonded web while making possible a reduced capital expenditure as well as reduced operating expenditures.

It is yet another object of the present invention to provide a process for forming a spun-bond web wherein reduced operating expenses are possible with respect to air-flow requirements when compared to technology of the prior art involving the use of an air forwarding jet to accomplish attenuation.

It is a further object of the present invention to provide an improved apparatus for the formation of a spun-bonded web.

These and other objects, as well as the scope, nature, and utilization of the invention will be apparent to those skilled in nonwoven technology from the following detailed description and appended claims.

SUMMARY OF THE INVENTION

It has been found that in a process for the formation of a spun-bonded web wherein a molten melt-processable polymeric material is passed through a plurality of extrusion orifices to form a multifilamentary spinline, the multifilamentary spinline is drawn in order to increase its tenacity, is passed through a quench zone wherein solidification occurs, is collected on a support to form a web, and is bonded to form a spun-bonded web; that improved results are achieved by passing the multifilamentary spinline in the direction of its length intermediate the quench zone and the support while wrapped about at least two spaced driven draw rolls that are surrounded at areas where the multifilamentary spinline contacts the draw rolls by a shroud having an entrance end and an exit end that is provided so that the entrance end of the shroud receives the multifilamentary spinline and a pulling force is exerted on the multifilamentary spinline primarily by the action of the spaced driven draw rolls to accomplish the drawing thereof adjacent the extrusion orifices, and exerting a further pulling force on the multifilamentary spinline by passage through a pneumatic forwarding jet located at the exit end of the shroud that assists in the contact of the multifilamentary spinline with the spaced driven draw rolls and expels the multifilamentary spinline in the direction of its length from the exit end of the shroud toward the support.

An apparatus for the production of a spun-bonded web is provided comprising in combination:

(a) a plurality of melt extrusion orifices capable of forming a multifilamentary spinline upon the extrusion of a molten thermoplastic polymeric material, (b) a quench zone capable of accomplishing the solidification of the molten multifilamentary thermoplastic polymeric spinline following the melt extrusion thereof, (c) at least two spaced driven draw rolls located downstream from the quench zone that are surrounded at areas where the multifilamentary thermoplastic polymeric spinline would contact the rolls by a shroud having an entrance end and an exit end that is provided so that the shroud is capable of receiving the multifilamentary thermoplastic polymeric spinline and the draw rolls are capable of exerting a pulling force on the multifilamentary thermoplastic polymeric spinline to accomplish the drawing thereof adjacent the extrusion orifices, (d) a pneumatic forwarding jet located at the exit end of the shroud that is capable of assisting the contact of the multifilamentary thermoplastic polymeric spinline with the spaced driven draw rolls and further is capable of expelling the multifilamentary thermoplastic polymeric spinline in the direction of its length from the exit end of the shroud, (e) a support located in a spaced relationship below the pneumatic forwarding jet that is capable of receiving the multifilamentary thermoplastic polymeric spinline and facilitating the laydown thereof to form a web, and (f) bonding means capable of bonding the multifilamentary thermoplastic polymeric spinline following the web formation to form a spun-bonded web.

DESCRIPTION OF THE DRAWING

The drawing at FIG. 1 is a schematic representation of an apparatus arrangement in accordance with the present invention that is capable of carrying out the improved process for the production of a spun-bonded web in accordance with the present invention.

DESCRIPTION OF PREFERRED EMBODIMENTS

Figures 1, 2:
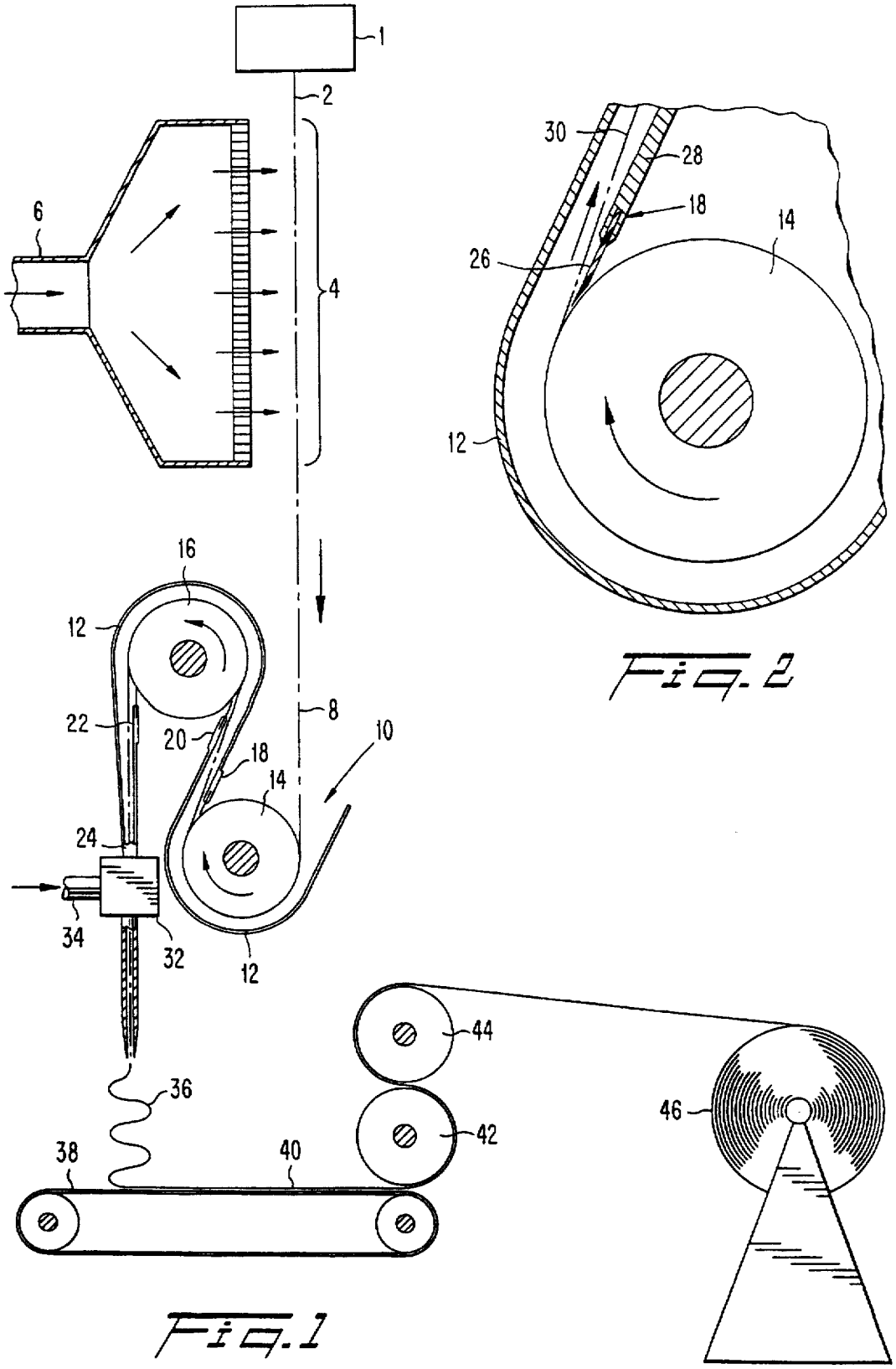
FIG. 2 illustrates in cross section in greater detail the nature of the polymeric edges that can be situated at areas where the shroud approaches the draw rolls to provide a substantially continuous passageway.

The starting material for use in the production of a spun-bonded web is a melt-processable thermoplastic polymeric material that is capable of being melt extruded to form continuous filaments. Suitable polymeric materials include polyolefins, such as polypropylene, and polyesters. Isotactic polypropylene is the preferred form of polypropylene. A particularly preferred isotactic polypropylene exhibits a melt flow rate of approximately 4 to 50 grams/10 minutes as determined by ASTM D-1238. The polyesters commonly are formed by the reaction of an aromatic dicarboxylic acid (e.g., terephthalic acid, isophthalic acid, naphthalene dicarboxylic acid, etc.) and an alkylene glycol (e.g., ethylene glycol, propylene glycol, etc.) as the diol. In a preferred embodiment the polyester is primarily polyethylene terephthalate. A particularly preferred polyethylene terephthalate starting material possesses an intrinsic viscosity (I.V.) of approximately 0.64 to 0.69 (e.g., 0.685) grams per deciliter, a glass transition temperature of approximately 75° to 80° C., and a melting temperature of approximately 260° C. Such intrinsic viscosity can be ascertained when 0.1 g. of the polyethylene terephthalate is dissolved per 25 ml. of solvent consisting of a 1:1 weight mixture of trifluoro acetic acid and methylene chloride while employing a No. 50 Cannon-Fenske viscometer at 25° C. Other copolymerized recurring units within the polymer chains than polyethylene terephthalate optionally can be present in minor concentrations. Also, some filaments of polyethylene isophthalate optionally can be included in the polyester spinline in a minor concentration so as to render the resulting web more readily amenable to thermal bonding. Additional representative thermoplastic polymeric materials include polyamides (e.g., nylon-6 and nylon-6,6), polyethylene (e.g., high density polyethylene), polyurethane, etc. Since the technology of the present invention is relatively user friendly, it further is possible to utilize a recycled and/or scrap melt-processable thermoplastic polymeric material (e.g., recycled polyethylene terephthalate).

When the starting thermoplastic polymeric material is a polyester (e.g. polyethylene terephthalate), it is recommended that polymeric particles of the same be pretreated by heating with agitation at a temperature above the glass transition temperature and below the melting temperature for a sufficient period of time to expel moisture and to bring about a physical modification of the surfaces of the particles so as to render them substantially non-sticky. Such pretreatment results in an ordering or crystallization of the surfaces of the particulate starting material and thereafter better enables the polymeric particles to flow and to be transferred in a readily controllable manner when being supplied to the melt-extrusion apparatus. In the absence of such pretreatment the polyester particles tend to clump. Starting materials such as isotactic polypropylene need not be subjected to such pretreatment since they inherently lack a propensity to clump. The moisture content of a polyethylene terephthalate starting material preferably does not exceed 25 ppm prior to extrusion.

The melt-processable thermoplastic polymeric material is heated to a temperature above its melting temperature (e.g., commonly to a temperature of approximately 20° to 60° C. above the melting temperature) and is passed to a plurality of melt extrusion orifices (i.e., a spinneret possessing a plurality of openings).

Commonly, the polymeric material is melted while passing through a heated extruder, is filtered while passing through a spinning pack located in a spinning block, and is passed through the extrusion orifices at a controlled rate by use of a metering pump. It is important that any solid particulate matter be removed from the molten thermoplastic polymer so as to preclude blockage of the spinneret holes. The size of the extrusion orifices is selected so as to make possible the formation of a multifilamentary spinline wherein the individual filaments are of the desired denier following drawing or elongation prior to complete solidification as described hereafter. Suitable hole diameters for the extrusion orifices commonly range from approximately 0.254 to 0.762 mm. (10 to 30 mils). Such hole cross-sections can be circular in configuration, or may assume other configurations, such as trilobal, octalobal, stars, dogbones, etc. Representatives pack pressures of approximately 8,268 to 41,340 kPa (1,200 to 6,000 psi) commonly are utilized with polyethylene terephthalate, and approximately 6,890 to 31,005 kPa (1,000 to 4,500 psi) commonly are utilized with isotactic polypropylene. When polyethylene terephthalate is the starting material, representative polymer throughput rates commonly range from 0.4 to 2.0 gram/min./hole, and when isotactic polypropylene is the starting material, representative polymer throughput rates commonly range from 0.2 to 1.5 gram/min./hole. The number of extrusion orifices and their arrangement can be varied widely. Such number of the extrusion orifices corresponds to the number of continuous filaments contemplated in the resulting multifilamentary fibrous material.

For instance, the number of extrusion orifices commonly can range from approximately 200 to 65,000. Such holes commonly are provided at a frequency of approximately 2 to 16 cm.$^2$ (10 to 100 per in.$^2$). In a preferred embodiment the extrusion orifices are arranged in a rectilinear configuration (i.e., as a rectilinear spinneret). For instance, such rectilinear spinnerets can have widths of approximately 0.1 to 4.0 meters (3.9 to 157.5 in.), or more, depending upon the width of the spunbonded nonwoven web that is to be formed. Alternatively, a multi-position spinning arrangement can be utilized.

A quench zone capable of accomplishing the solidification of the molten multifilamentary thermoplastic polymeric spinline following melt extrusion is located below the extrusion orifices. The molten multifilamentary spinline is passed in the direction of its length through the quench zone provided with a gas at low velocity and high volume where it preferably is quenched in a substantially uniform manner in the absence of undue turbulence. Within the quench zone the molten multifilamentary spinline passes from the melt to a semi-solid consistency and from the semi-solid consistency to a fully solid consistency. Prior to solidification when present immediately below the extrusion orifices, the multifilamentary spinline undergoes a substantial drawing and orientation of the polymeric molecules. The gaseous atmosphere present within the quench zone preferably circulates so as to bring about more efficient heat transfer. In a preferred embodiment of the process the gaseous atmosphere of the quench zone is provided at a temperature of about 10° to 60° C. (e.g., 10° to 50° C.), and most preferably at about 10° to 30° C. (e.g., at room temperature or below).

The chemical composition of the gaseous atmosphere is not critical to the operation of the process provided the gaseous atmosphere is not unduly reactive with the melt-processable thermoplastic polymeric material. In a particularly preferred embodiment of the process, the gaseous atmosphere in the quench zone is air having a relative humidity of approximately 50 percent. The gaseous atmosphere is preferably introduced into the quench zone in a cross-flow pattern and impinges in a substantially continuous manner on one or both sides of the spinline. Other quench flow arrangements may be similarly utilized. Typical lengths for the quench zone commonly range from 0.5 to 2.0 m. (19.7 to 78.7 in.). Such quench zone may be enclosed and provided with means for the controlled withdraw of the gas flow that is introduced thereto or it simply may be partially or completely open to the surrounding atmosphere.

The solidified multifilamentary spinline is wrapped about at least two spaced driven draw rolls that are surrounded by a shroud at areas where the multifilamentary spinline is wrapped about the rolls. If desired, one or more additional pairs of spaced draw rolls can be provided in series and similarly surrounded by the same continuous shroud. The multifilamentary spinline typically is wrapped about the draw rolls at wrap angles of approximately 90 to 270 degrees, and preferably at wrap angles within the range of approximately 180 to 230 degrees. The shroud is provided in a spaced relationship to the draw rolls and provides a continuous channel in which the spinline can freely pass. The draw rolls exert a pulling force on the spinline so as to accomplish the drawing thereof adjacent the extrusion orifices and prior to complete solidification in the quench zone. At the exit end of the shroud a pneumatic forwarding jet is located that assists in the contact of the multifilamentary spinline with the spaced draw rolls and expels the multifilamentary spinline in the direction of its length from the exit end of the shroud toward a support where it is collected as described hereafter.

The driven draw rolls which are utilized in accordance with the present invention possess lengths that exceed the width of the spun-bonded multifilamentary fibrous web that is being formed. Such draw rolls may be formed from cast or machined aluminum or other durable material. The surfaces of the draw rolls preferably are smooth. Representative diameters for the draw rolls commonly range from approximately 10 to 60 cm. (3.9 to 23.6 in.). In a preferred embodiment the draw roll diameter is approximately 15 to 35 cm. (5.9 to 13.8 in.). As will be apparent to those skilled in fiber technology, the roll diameter and spinline wrap angle will largely determine the spaced relationship of the draw rolls. During the operation of the process of the present invention the draw rolls commonly are driven at surface speeds within the range of approximately 1,000 to 5,000, or more, meters per minute (1,094 to 5,468 yds./min.), and preferably at surface speeds within the range of approximately 1,500 to 3,500 meters per minute (1,635 to 3,815 yds./min.).

The driven draw rolls impart a pulling force to the multifilamentary spinline which accomplishes a substantial drawdown of the spinline that takes place at an area situated upstream prior to the complete solidification of the individual filaments present therein.

The presence of a shroud or enclosure surrounding the draw rolls is a key feature of the overall technology of the present invention. Such shroud is sufficiently spaced from the surfaces of the draw rolls to provide an unobstructed and continuous enclosed passage to accommodate the multifilamentary spinline that is wrapped on the draw rolls as well as to accommodate the uninterrupted flow of gas from the entrance end to the exit end. In a preferred embodiment the inner surface of the shroud enclosure is spaced no more than approximately 2.5 cm. (1 in.) from the draw rolls, and no less than approximately 0.6 cm. (0.24 in.) from the draw rolls. A pneumatic forwarding jet in communication with the exit end of the shroud causes a gas, such as air, to be drawn into the entrance end of the shroud, to flow smoothly around the surfaces of the draw rolls bearing the multifilamentary spinline, and to be expelled downwardly out of such pneumatic forwarding jet. The shroud that defines the outer boundary of such continuous passageway is provided as a hood about the draw rolls and can be formed of any durable material, such as polymeric or metallic materials. In a preferred embodiment the shroud is formed at least partially of a clear and sturdy polymeric material such as a polycarbonate-linked material that enables ready observation of the spinline from the outside. If the spacing of the shroud with respect to the draw rolls is too distant, the velocity of the gas flow in the shroud tends to become unduly low so as to preclude the imposition of the desired improved contact between the multifilamentary spinline and the driven draw rolls.

For best results, the area of confined gas flow created within the shroud is smooth and substantially free of obstruction or areas where gas dissipation could occur throughout the length of the shroud from its entrance end to the exit end. This precludes any substantial interruption or loss of the gas flow at an intermediate location within the shroud during the practice of the present invention. When the gas flow within the shroud is substantially continuous and undisturbed, such flow achieves its intended function of enhancing the contact between the driven draw rolls and the multifilamentary spinline that is wrapped on such draw rolls. The possibility of slippage of the multifilamentary spinline when wrapped on the draw rolls is overcome or is greatly minimized. In a preferred embodiment of the present invention the shroud includes polymeric edges or extensions (i.e., aerodynamic deflectors) that are capable of being positioned in close proximity to the driven draw rolls throughout the roll lengths at areas immediately following the points where the multifilamentary spinline leaves the draw rolls and immediately prior to the point where the multifilamentary spinline engages the second draw roll. These make possible a substantially complete enclosure of the draw rolls with such edges preferably being capable of ready disintegration preferably as a fine powder when contact is made with the draw rolls. Such polymeric edges preferably possess a relatively high melting temperature and approach each draw roll while leaving a very slight opening on the order of 0.1 to 0.08 mm. (0.5 to 3 mils). Representative polymeric materials suitable for use when forming the polymeric edges include polyimides, polyamides, polyesters, polytetrafluoroethylene, etc. Fillers such as graphite optionally may be present therein. Uniform gas flow within the shroud is maintained and undesirable roll wraps of the multifilamentary spinline are precluded. Accordingly, the necessity to shut down the spinline in order to correct roll wraps is greatly minimized and the ability to continuously form a uniform spun-bonded web product is enhanced.

The pneumatic forwarding jet located at the exit end of the shroud provides a continuous downwardly-directed gas flow, such as air flow, at the exit end of the shroud. Such forwarding jet introduces a gas flow substantially parallel to the movement of the spinline while the spinline passes through an opening provided in the pneumatic forwarding jet. A continuous flow of gas throughout the shroud is created via aspiration imparted by the pneumatic forwarding jet with a supply of gas additionally being drawn into the entrance end of the shroud and flowing throughout the length of the shroud. The gas flow entering the entrance end of the shroud merges with that introduced by the pneumatic forwarding jet. The downwardly flowing gas introduced by such pneumatic forwarding jet impinges the spinline and exerts a further pulling force thereon sufficient to assist in the maintenance of uniform roll contact in the substantial absence of slippage. The gas velocity imparted by the pneumatic forwarding jet exceeds the surface speed of the driven draw rolls so that the requisite pulling force is made possible. Such pneumatic forwarding jet with the assistance of the air flow created in the shroud has been found to facilitate good contact with the draw rolls in order to make possible the uniform drawing of the continuous filaments within the resulting nonwoven product. The pneumatic forwarding jet creates a tension on the spinline that helps maintain the spinline in good contact with the draw rolls. A product of superior filament denier uniformity is formed while precluding slippage between the multifilamentary spinline and the draw rolls in the context of the overall process. Such pneumatic forwarding jet does not serve any substantial filament drawing or elongation function with the drawing force being primarily created by the rotation of the driven draw rolls. Pneumatic forwarding jets capable of advancing a multifilamentary spinline upon passage through the same while exerting sufficient tension to well retain the spinline on the draw rolls in the substantial absence of slippage may be utilized.

If desired, an electrostatic charge optionally can be imparted to the moving spinline from a high voltage low amperage source in accordance with known technology in order to assist filament laydown on the support (described hereafter).

The support is located in a spaced relationship below the pneumatic forwarding jet that is capable of receiving the multifilamentary spinline and facilitates the laydown thereof to form a web. Such support preferably is a moving continuous and highly air permeable rotating belt such as that commonly utilized during the formation of a spun-bonded nonwoven wherein a partial vacuum is applied from below such belt which contributes to the laydown of the multifilamentary spinline on the support to form a web. The vacuum from below preferably balances to some degree the air emitted by the pneumatic forwarding jet. The unit weight of the resulting web can be adjusted at will through a modification of the speed of the rotating moving belt upon which the web is collected. The support is provided in a spaced relationship below the pneumatic forwarding jet at a sufficient distance to allow the multifilamentary spinline to spontaneously buckle and to curl to at least some extent as its forward movement slows before being deposited on the support in a substantially random manner. An excessively high fiber alignment in the machine direction is precluded in view of substantially random laydown during web formation.

The multifilamentary spinline next is passed from the collecting support to a bonding device wherein adjacent filaments are bonded together to yield a spun-bonded web. Commonly the web is further compacted by mechanical means prior to undergoing bonding in accordance with technology commonly utilized in nonwoven technology of the prior art. During bonding portions of the multifilamentary product commonly pass through a high pressure heated nip roll assembly and are heated to the softening or melting temperature where adjoining filaments that experience such heating are caused to permanently bond or fuse together at crossover points. Either pattern (i.e., point) bonding using a calendar or surface (i.e., area) bonding across the entire surface of the web can be imparted in accordance with techniques known in the art. Preferably such bonding is achieved by thermal bonding through the simultaneous application of heat and pressure. In a particularly preferred embodiment the resulting web is bonded at intermittent spaced locations while using a pattern selected to be compatible with the contemplated end use. Typically bond pressures range from approximately 17.9 to 89.4 Kg./ linear cm. (100 to 500 lbs./linear in.) and bond areas commonly range from approximately 10 to 30 percent of the surface undergoing such pattern bonding. The rolls may be heated by means of circulating oil or by induction heating, etc. Suitable thermal bonding is disclosed in U.S. Pat. No. 5,298,097 which is herein incorporated by reference.

The spun-bonded web of the present invention typically includes continuous filaments of approximately 1.1 to 22 dTex (1 to 20 denier). The preferred filament dTex for polyethylene terephthalate is approximately 0.55 to 8.8 (0.5 to 8 denier), and most preferably 1.6 to 5.5 (1.5 to 5 denier). The preferred filament dTex for isotactic polypropylene is approximately 1.1 to 11 (1 to 10 denier), and most preferably 2.2 to 4.4 (2 to 4 denier). Commonly a polyethylene terephthalate filament tenacity of approximately 2.2 to 3.4 dN/dTex (2.0 to 3.1 grams per denier) and an isotactic polypropylene filament tenacity of 13.2 to 17.7 dN/dTex (1.5 to 2 grams per denier) are obtained in the spun-bonded webs formed in accordance with the present invention. Relatively uniform nonwoven webs having a basis weight of approximately 13.6 to 271.7 g./m.$^2$ (0.4 to 8.0 oz./yd.$^2$) commonly are formed. In a preferred embodiment the weight basis is approximately 13.6 to 67.9 g./m.$^2$ (0.4 to 2.0 oz./yd.$^2$). Nonwoven products preferably having a unit weight coefficient of web variation at least as low as 4 percent determined over a sample of 232 cm.$^2$ (36 in.$^2$) can be formed in accordance with the technology of the present invention.

The technology of the present invention is capable of forming a highly uniform spun-bonded nonwoven web on an expeditious basis in the absence of highly burdensome capital and operating requirements. Further economies are made possible by the ability to utilize scrap and/or recycled thermoplastic polymeric material as the starting material. The self-stringing capability of the technology further assures minimal startup activity by workers thereby maximizing production from a given facility.

The following examples are given as specific illustrations of the present invention with reference being made to FIG. 1 and FIG. 2 of the drawings. It should be understood, however, that the invention is not limited to the specific details set forth in the examples.

In each instance the thermoplastic polymeric material while in flake form was fed to a heated MPM single screw extruder (not shown) and was fed while molten through a heated transfer line to a Zenith pump (not shown) having a capacity of 11.68 cm.$^3$/revolution (0.71 in.$^3$/revolution) to pack/spinneret assembly 1. The extruder control pressure was maintained at approximately 3,445 kPa (500 lbs./in.$^2$). The thermoplastic polymer while molten passed through pack/spinneret assembly 1 that included a filter medium to form a molten multifilamentary thermoplastic polymeric spinline 2. The resulting multifilamentary spinline next was quenched while passage through quench zone 4 having a length of 0.91 m. (36 in.) wherein air at a temperature of approximately 13° C. engaged the spinline in a substantially perpendicular and non-turbulent manner from one side that was supplied through conduit 6 and was introduced at a flow rate of 35.9 cm./sec. (110 ft./min.).

A lower portion of the spinline 8 next entered the entrance end 10 of shroud 12 that surrounded driven draw rolls 14 and 16 at areas where the spinline was wrapped about such draw rolls. The draw rolls 14 and 16 had diameters of 19.4 cm. (7.6 in.). The spinline engaged each draw roll at an angle of approximately 210 degrees. The inner surface of the shroud 12 was spaced at a distance of approximately 2.5 cm. (1 in.). from the surfaces of draw rolls 14 and 16 at areas where the spinline was wrapped about such rolls. As shown in FIG. 1, polymeric extensions or edges 18, 20, and 22 were provided to facilitate the formation of a substantially complete passageway from the entrance end 10 to the exit end 24 of shroud 12. The details of a representative polymeric extension or edge are shown in greater detail in FIG. 2 wherein replaceable polymeric edge 26 is mounted in holder 28 of shroud 12. The polymeric edge 26 and holder 28 form a portion of shroud 12 through which the spinline passes. The polymeric edge or extension 18 of FIG. 1 corresponds to replaceable polymeric edge 26 with holder 28 of FIG. 2. Any contact of the polymeric edge 26 with the draw roll 14 causes the disintegration of such edge as a powder without any significant harm to such draw roll. In FIG. 2 the spinline is indicated at 30 as it leaves the first draw roll 14. The draw rolls 14 and 16 as shown in FIG. 1 facilitate the drawing of the spinline 2 prior to its complete solidification.

At the exit end 24 of shroud 12 was located pneumatic forwarding jet 32 wherein air was introduced through conduit 34 and was directed downwardly substantially parallel to the direction of the movement of the spinline. The air pressure within the jet was 186 kPa (27 lbs./in.$^2$), and approximately 4.2 m.$^3$ (150 ft.$^3$) of air was consumed per minute. The air velocity imparted by the pneumatic forwarding jet 32 exceeded the surface speed of the draw rolls 14 and 16. The pneumatic forwarding jet 32 imparted a farther pulling force on the spinline, caused additional air to be sucked in to shroud 12 at entrance end 10, created an air flow throughout the length of the shroud 12, and facilitated a uniform wrapping of the spinline on the draw rolls 14 and 16 in the substantial absence of slippage so that uniform drawing was made possible. Also, the pneumatic forwarding jet 32 caused the spinline 36 to be expelled from the exit end 24 of the shroud 12 toward support 38 that was provided as a moving air-permeable continuous belt.

As the spinline 36 left pneumatic forwarding jet 32 the individual continuous filaments present therein become curled in a generally random manner as the velocity of the spinline decreased and its forward movement slowed since a vigorous pulling force no longer was being imparted to the same. The spinline next was collected on support 38 in a substantially random manner. Such support or laydown belt 38 was commercially available from Albany International of Portland, Tennessee, under the designation Electrotech 20. The support 38 was positioned in a spaced relationship below the exit port of pneumatic forwarding jet 32.

The resulting web 40 while present on support 38 next was passed around compaction roll 42 and pattern-bonding roll 44. Pattern-bonding roll 44 possessed an engraved diamond pattern on its surface and was heated to achieve softening of the thermoplastic polymeric material. Bonded areas extending over approximately 20 percent of web surface were achieved as the web passed between compaction roll 42 and pattern-bonding roll 44. The resulting spun-bonded web was next rolled and collected at 46. Further details concerning the Examples are specified hereafter.

EXAMPLE 1

The thermoplastic polymeric material was commercially available polyethylene terephthalate having an intrinsic viscosity of 0.685 grams per deciliter. The intrinsic viscosity was determined as described earlier. Such polymeric material while in flake form initially was pretreated at approximately 174° C. to achieve crystallization and was dried in desiccated air at approximately 149° C. A spinning pack pressure of 13,780 kPa (2,000 lbs./in.$^2$) was utilized. The spinneret consisted of 384 evenly spaced holes across a width of 15.2 cm. (6 in.). The spinneret capillaries possessed a trilobal configuration with a slot length of 0.38 mm. (0.015 in.), a slot depth of 0.18 mm. (0.007 in.), and a slot width of 0.13 mm. (0.005 in). The molten polyethylene terephthalate was fed at a rate of 1.2 gram/min./hole and was extruded at a temperature of 307° C.

The driven draw rolls 14 and 16 were rotated at a surface speed of approximately 2,743 meters/min. (3,000 yds./min.). The filaments of the product possessed a dTex of approximately 4.5 (a denier of 4.1), and a tenacity of approximately 20.3 dN/dTex (2.3 grams per denier). The speed of the laydown belt 38 was varied so as to form spun-bonded webs that varied in unit weight from 13.6 to 135.8 g/m.$^2$ (0.4 to 4.0 oz./yd.$^2$). A spun-bonded product having a unit weight of 105.3 g./m.$^2$ (3.1 oz./yd.$^2$) exhibited a unit weight coefficient of variation of only 4 percent over a sample of 232 cm.$^2$ (36 in.$^3$).

EXAMPLE 2

The thermoplastic polymer was commercially available isotactic polypropylene having a melt flow rate of 40 grams/10 minutes as determined by ASTM D-1238. Such polymeric material was supplied in flake form and was melt extruded. A spinning pack pressure of 9,646 kPa (1,400 lbs./in.$^2$) was utilized. The spinneret consisted of 240 evenly spaced holes across a width of 30.5 cm. (12 in.). The spinneret capillary possessed a circular configuration with a diameter of 0.038 cm. (0.015 in.), and a slot length of 0.152 cm. (0.060 in.). The molten isotactic polypropylene was fed at a rate of 0.6 gram/min./hole and was extruded at a temperature of 227° C.

The driven rolls 14 and 16 were rotated at a surface speed of approximately 1,829 meters/min (2,000 yds./min.). The filaments of the product possessed a dTex of approximately 3.3 (denier of 3.0) and a tenacity of approximately 15.9 dN/dTex (1.8 grams per denier). The speed of the laydown belt 38 was varied so as to form spun-bonded webs that varied in unit weight from 0.4 to 2.0 oz./yd.$^2$ (13.6 to 67.9 g./m.$^2$). A spun-bonded product having a unit weight of 44.1 g./m.$^2$ (1.3 oz./yd.$^2$) exhibited a unit weight coefficient of variation of only 3.3 percent over a sample of 232 cm.$^2$ (36 in.$^2$).

Although the invention has been described with preferred embodiments, it is to be understood that variations and modifications may be resorted to as will be apparent to those skilled in the art. Such variations and modifications are to be considered within the purview and scope of the claims appended hereto.

We claim:

1. An apparatus for the production of a spun-bonded web comprising in combination:

a plurality of melt extrusion orifices for forming a multifilamentary spinline upon the extrusion of a molten thermoplastic polymeric material therethrough, a gaseous quench zone in which said molten multifilamentary thermoplastic polymeric spinline travels and is solidified following the melt extrusion thereof, at least two spaced driven draw rolls located downstream from said quench zone and arranged to be contacted by said multifilamentary thermoplastic polymeric spinline for exerting a pulling force on said multifilamentary thermoplastic polymeric spinline to accomplish the drawing thereof adjacent said extrusion orifices, a shroud for the passage of said multifilamentary thermoplastic polymeric spinline when contacting said draw rolls, with said shroud completely surrounding areas of said draw rolls contacted by said multifilamentary thermoplastic polymeric spinline, said shroud including an entrance end and an exit end, a pneumatic forwarding jet located adjacent said exit end of said shroud for the creation of an uninterrupted flow of gas from the entrance end to the exit end of said shroud which is directed for assisting the contact of said multifilamentary thermoplastic polymeric spinline with said spaced driven draw rolls and expelling said multifilamentary thermoplastic polymeric spinline in the direction of its length from said exit end of said shroud, a support located in a spaced relationship below said pneumatic forwarding jet for receiving said multifilamentary thermoplastic polymeric spinline and facilitating the laydown thereof to form a web, and bonding means for bonding said multifilamentary thermoplastic polymeric spinline following said web formation to form a spun-bonded web.

2. An apparatus according to claim 1 wherein said plurality of melt extrusion orifices are provided as a rectilinear spinneret.

3. An apparatus according to claim 1 wherein said gaseous quench zone is arranged to provide a cross-flow quench wherein a cooling gas impinges said molten multifilamentary thermoplastic polymeric spinline following said melt extrusion.

4. An apparatus according to claim 1 wherein said shroud includes polymeric edges positioned in close proximity to said draw rolls to facilitate a substantially complete enclosure of said draw rolls when contacted by said multifilamentary thermoplastic polymeric material, said polymeric edges being disintegratable as a powder upon contact with said draw rolls.

5. An apparatus according to claim 1 wherein said support comprises a continuous belt.

6. An apparatus according to claim 1 wherein said bonding means comprises means for forming a pattern-bonded spun-bonded web.

7. An apparatus according to claim 1 wherein said bonding means comprises means for forming a surface-bonded spun-bonded web.

* * * * *

UNITED STATES PATENT AND TRADEMARK OFFICE

CERTIFICATE OF CORRECTION

PATENT NO. : 5,750,151

DATED : May 12, 1998

INVENTOR(S) : Edward L. Brignola et al.

It is certified that error appears in the above-indentified patent and that said Letters Patent is hereby corrected as shown below:

Title page, inventors:

At [75] delete ", by Patricia B. Zimmerman, legal representative"

Signed and Sealed this

Twenty-eighth Day of July, 1998

*Attest:*

*Attesting Officer*

BRUCE LEHMAN

*Commissioner of Patents and Trademarks*